United States Patent [19]

Yurik

[11] 4,223,933

[45] Sep. 23, 1980

[54] LOCKING TONG FOR HANDLING FUEL

[76] Inventor: Peter P. Yurik, Rte. 1, Box 111, Woodford, Va. 22580

[21] Appl. No.: 16,493

[22] Filed: Mar. 1, 1979

[51] Int. Cl.[3] ..... A47J 49/14

[52] U.S. Cl. ..... 294/11

[58] Field of Search ..... 294/11, 9, 10, 12, 13, 294/14, 9 M, 109 R, 106, 115

[56] References Cited

U.S. PATENT DOCUMENTS

| | | | |
|---|---|---|---|
| 824,642 | 6/1906 | Gibbs | 294/11 |
| 1,021,290 | 3/1912 | Althouse | 294/11 |
| 1,254,765 | 1/1918 | Binn | 294/11 |
| 1,313,788 | 8/1919 | Brown | 294/11 |
| 1,526,517 | 2/1925 | Voght | 294/11 |
| 1,853,899 | 4/1932 | Haverstick | 294/11 |
| 1,857,841 | 5/1932 | Engel | 294/11 |
| 1,884,541 | 10/1932 | Blohm, Jr. | 294/11 |
| 1,976,977 | 10/1934 | Zinky | 294/11 |
| 2,135,232 | 11/1938 | Dawn | 294/19 A |
| 2,419,046 | 10/1947 | Billig | 294/11 |
| 3,124,384 | 3/1964 | Ezzell | 294/88 |

*Primary Examiner*—James B. Marbert

*Attorney, Agent, or Firm*—Lowe, King, Price & Becker

[57] ABSTRACT

A locking tong apparatus for securely grasping variable size fireplace or furnace fuel includes a fixed gripper element on one end of an elongate arm and an opposed gripper element on a tubular carrying member coupled on the arm. The two gripper elements define a jaw for holding the fuel, the size of the jaw opening being adjustable by manually sliding the tubular carrying member along the length of the arm. A lever operated, clinch lock is provided on the carrying member to retain the fuel load between the gripper elements following manual adjustment of the jaw opening. In use the lever is oriented below the arm of the locking tong in the hand of the operator to enable the weight of the fuel load to help deflect the lever and more securely lock the jaw.

9 Claims, 6 Drawing Figures

LOCKING TONG FOR HANDLING FUEL

BACKGROUND OF THE INVENTION

This invention realtes generally to article handling apparatus and more particularly to a locking tong for securely grasping variable size, fireplace or furnace fuel.

In order to obtain heat from a fireplace or furnace, it is necessary to continuously move fuel from a supply area to the fireplace or furnace and to arrange the fuel in the fireplace or furnace for efficient burning. It is essential in moving or arranging the fuel that there be a sure grip between the fuel and holding tool. Often, fireplace fuel, such as wood, tends to be of variable size and heavy.

One type of prior art tool requires that a constant pressure be exerted by the user directly on the fuel load in order to maintain a tight grip by the tool. The requirement of applying constant pressure can be physically tiring to the user. U.S. Pat. Nos. 824,642, 1,313,788, 1,526,517, 1,884,541 and 2,429,046 disclose this type of tool.

Another type of prior art tool is incapable of handling fuel of a wide range of sizes with a sure grip. For example, U.S. Pat. No. 1,976,977 discloses a tool having a pivotal conection between its fuel-gripping members. This pivotal connection limits the size of the fuel which can be held between the members.

A third type of tool uses a spring to bias the gripping members together and requires force by the user to overcome the spring force to open the gripping members. Since spring tension decreases with use, however, slipping of the load between the gripping members eventually occurs. Furthermore, this type of tool requires the user to exert a substantial force against the spring to separate the normally closed gripping members. Exemplary of this type of prior art tool are U.S. Pat. Nos. 1,254,765, 1,857,841 and 1,976,977.

In U.S. Pat. No. 1,021,290, a fireplace fuel gripper uses rack and pinion assembly for mechanically exerting a gripping force between pairs of holding tines. This tool will not provide a sure grip over long use since wear may eventually produce slippage in the assembly resulting in uncertain gripping of the load. Furthermore, the length of the rack limits the size of the load which can be securely held.

Additionally, other prior art tools of which I am aware are difficient in that some do not provide any mechanical advantage to reduce the force which the user must exert to maintain a secure grip on the load and others are difficult to manufacture.

SUMMARY OF THE INVENTION

It is accordingly an object of the present invention to provide a new and improved apparatus for securely gripping variable size fireplace or furnace fuel.

It is a further object of the present invention to provide a new and improved apparatus for securely gripping fuel that does not require a constant gripping pressure to be exerted by the user directly on the fuel load.

It is a still further object of the present invention to provide a new and improved apparatus for securely gripping fuel over a long period of continuous use.

It is an even further object of the present invention to provide a locking tong apparatus that does not require application of force by the user to offset spring force used to maintain the gripping members together.

It is an additional object of the present invention to provide a locking tong apparatus that reduces the force which must be exerted by the user to maintain a gripping action by the tool.

It is an even additional object of the present invention to provide a tong apparatus that is easy to manufacture.

Other aspects and advantages of the present invention will become apparent as the description thereof proceeds.

In satisfaction of the foregoing objects and objectives, a locking tong apparatus, in accordance with the invention, comprises a fixed gripper element provided at one end of an elongate arm and an opposed, movable gripper element attached to a tubular carrying member on the arm. The carrying member is slideably mounted on the elongate arm and is adapted to be moved along substantially the entire length of the arm between the handle end and the remote end. The first and second gripper elements together provide a gripping jaw for holding the fuel. A lever operated clinch lock is provided on the carrying member of selectively locking the carrying member into a fuel-retaining position on the elongate arm. When the lever is operated, the clinch lock tends to bite the surface of the elongate arm, fixing the size of the jaw opening. With the lever oriented below the arm and seated in the user's hand, the weight of the load helps deflect the lever to more securely hold the load between the gripping elements.

In the description of the drawing and in the detailed discussion of the invention which follows, I have shown and essentially described only the preferred embodiment of the invention, simply by way of illustration of the best mode contemplated by me of carrying out my invention. As will be realized, the invention is capable of other and different embodiments, and its several details are capable of modifications in various respects, all without departing from the invention. Accordingly, the drawing and description are to be regarded as illustrative in nature, and not as restrictive.

BEST MODE FOR CARRYING OUT THE INVENTION

Figure 1:
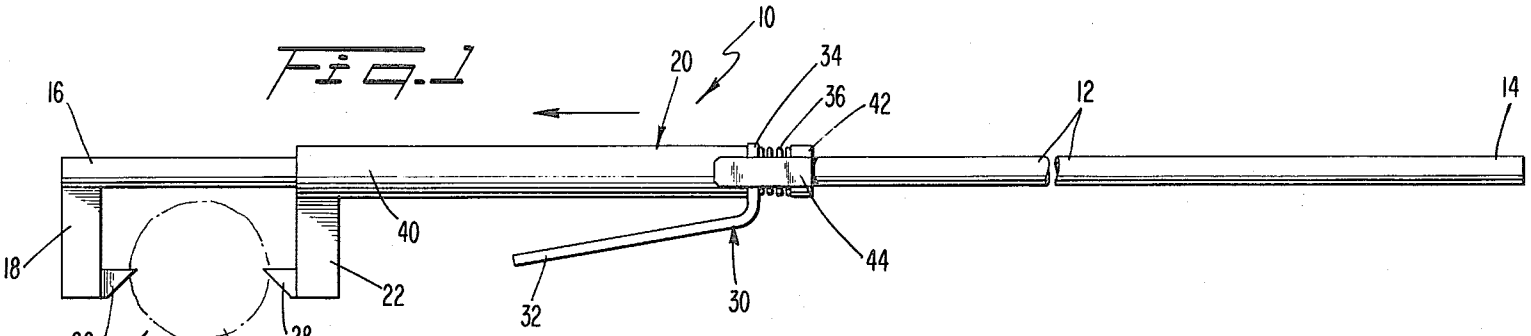
FIG. 1 is a side view of the locking tong of the present invention holding a fuel load shown in phantom.
Figure 2:
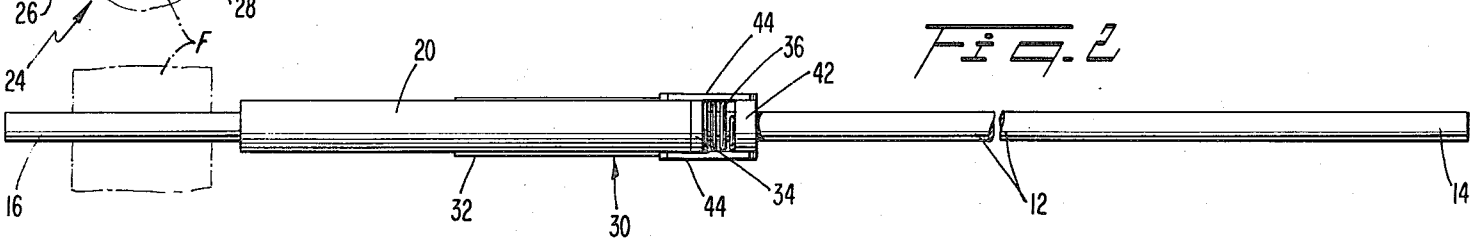
FIG. 2 is a top view of the locking tong of FIG. 1.

Referring to FIGS. 1 and 2, a tong 10, in accordance with the present invention, comprises an elongate arm 12 having a handle end 14 and a remote end 16. A fixed gripper element 18 welded to the arm 12 at end 16 extends transversely to the arm, to contact one end of a fuel load F, shown in phantom. Slideably mounted on the enlongate arm 12 is a tubular carrying member 20 for a movable gripper element 22, which in combination with gripper element 18, defines a gripping jaw 24. The carrying member 20 is manually movable along the substantially entire length of arm 12 between the handle end 14 and the remote end 16 by manually sliding the member 20 with one hand while gripping the end 14 of arm 12 with the other. The longitudinal freedom of movement of carrying member 20 along the arm 12 enables the size of jaw 24 to be freely adjusted to accommodate any fuel load that is customarily used in a furnace or fireplace.

Gripper elements 18 and 22 preferably comprise mutually opposed gripper teeth 26 and 28, respectively, that engage opposite ends of the fuel load F. The contact portions of teeth 26, 28 are preferably pointed to pierce the ends of load F to prevent slipping. Other configurations, however, could alternatively be used.

Figure 3:
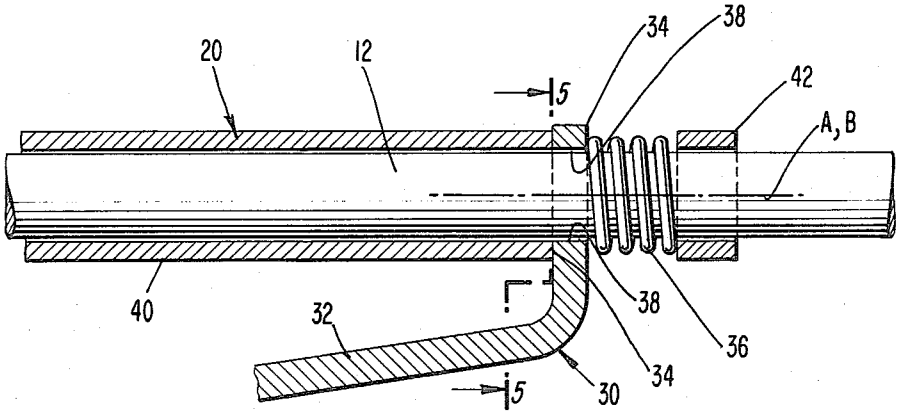
FIG. 3 and 4 are partial side views of the locking tong shown in FIG. 1, in the unlocked and locked positions, respectively.

Of particular importance, on carrying member 20 there is provided a locking assembly 30, which is manually operated to selectively lock carrying member 20 into a position on the arm 12 to retain the fuel load in the jaw 24. The locking assembly 30 comprises a lever 32 extending outwardly from carrying member 20 and having a collar portion 34 formed on one end that surrounds the arm 12. The inner surface 38 of collar portion 34 is normally parallel to the outer surface of enlongate arm 12 when oriented with its axis A coincident with the axis B of arm 12 (FIG. 3) to enable the carrying member 30 to be moved along the surface of the arm. When the axis A of the collar portion 34 of lever 30 is inclined, however, so that axes A and B are non-coincident (FIG. 4), opposite edges of inner surface 38 tend to bite into the surface of the arm 12, as shown, to secure the position of the member 20 on arm 12 and thereby fix the opening of jaw 24. Collar portion 34 thus forms a clinch lock that is resiliently biased into the unlocked position of FIG. 3 by spring 36 and is manually pivoted into the locked position of FIG. 4 by operating lever 30.

Locking assembly 30 has the advantage of providing jaw 24 with a non-slipping grip without requiring the user to exert a constant pressure directly on jaw 24. In other words, the locking function is provided by contact between the inner surface 38 of collar portion 34 rather than by force applied directly to the gripping jaw 24. Furthermore, mechanical wear of inner surface 38 increases its surface area to result in greater friction between surface 38 and arm 12 when in the locked position, and thereby offsets dulling of the biting edges through wear. The locking tong apparatus of the present invention therefore securely grasps a fuel load even after long and continued use.

Figure 4:
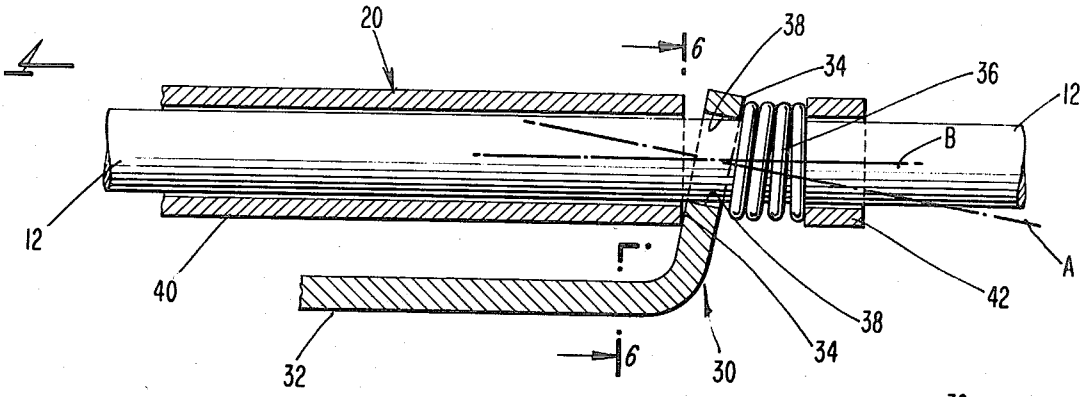
Figure 6:
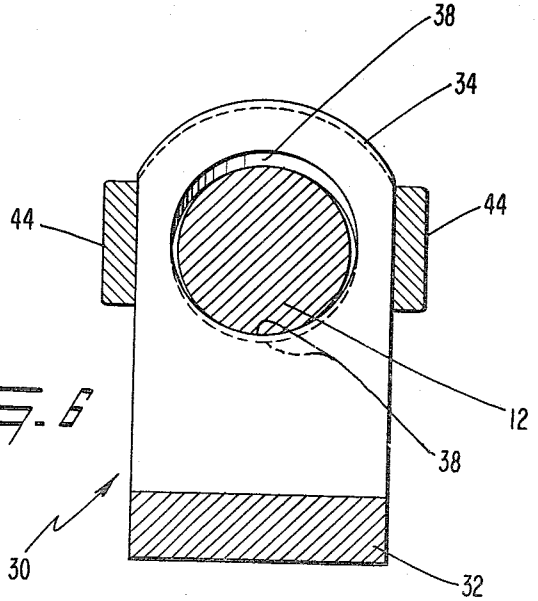
FIG. 6 is a cross-sectional view of the tong taken along the line 6—6 in FIG. 4.
Figure 5:
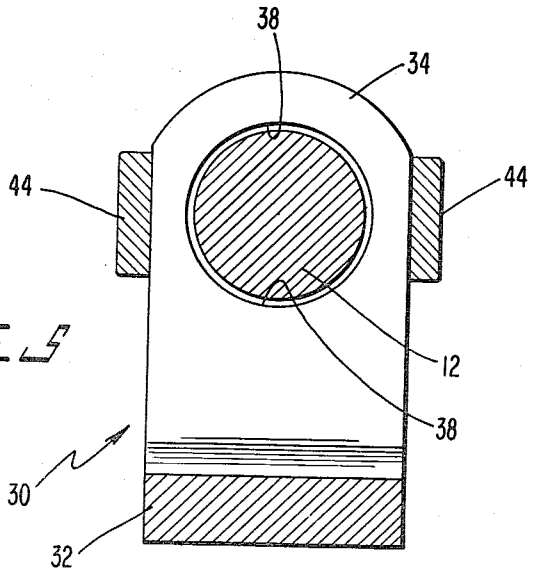
FIG. 5 is a cross-sectional view of the tong taken along the line 5—5 in FIG. 3.

The operation of the clinch lock 30 is shown in more detail in FIGS. 5 and 6. FIG. 5 more clearly illustrates that there is no contact between inner surface 38 of collar portion 34 and arm 12 when the collar portion 34 is unlocked; FIG. 6 shows the biting contact between the collar portion 34 and arm 12, corresponding to FIG. 4.

Referring to FIG. 4, clinch lock 30 is positioned downwardly on carrying member 20 so as to be in alignment with gripper element 22. This position enables the weight of the fuel load on the hand which supports lever 32 to reduce the force that the user must exert in order to pivot collar portion 34 into the locked position shown in FIG. 4.

Also referring to FIG. 4, lever 32, when in the locked position, is parallel to arm 12. This parallel relationship assists the user in balancing tong 10, when the tong is grasping a fuel load. Obviously, clinch lock 30 could be positioned differently and lever 32 could be at an angle with respect to arm 12, but neither to these modifications would produce the advantages described above.

Referring again to FIGS. 1 and 2, carrying member 20 comprises a hollow member 40 and a bushing 42 that are maintained rigidly spaced apart from one another. These two elements are maintained in this spaced apart relationship by bridging elements 44, which rigidly attach hollow member 40 and bushing 42 to one another. Although hollow member 40 is a conduit and bushing 42 is a ring in the preferred embodiment, obviously hollow member 40 and bushing 42 could be rectangular in cross section or have any other cross sections corresponding to the cross section of arm 12. Also hollow member 40 and bushing 42 could have a shape different from the cross section of arm 12, with the only limitation being that carrying member 20, which these two elements comprise, be slideably movable over arm 12.

Collar portion 34 and spring 36 are located between hollow member 40 and bushing 42. Arm 12 passes through the hollow member 40, bushing 42, arm-surrounding portion 34, and spring 36. However, it is within the skill of the art to use other spring biasing configurations through which the arm 12 does not pass.

In use, handle end 14 of arm 12 is held by one hand of the user, and carrying member 20 is grasped by the user's other hand with the lever 32 oriented downwardly in the palm. Gripper element 22 is moved toward handle end 14 by manually sliding carrying member 20. Remote end 16 of arm 12 is then positioned over the fuel load. Next, carrying member 20 is manually moved toward remote end 16 until gripper elements 18 and 22 contact and actually bite into the ends of the fuel load F. Finally, locking assembly (clinch lock) 30 is manually pivoted by squeezing lever 32 into the locked position shown in FIG. 4 by the same hand used to move carrying member 20. The fuel load is now securely grasped by tong 10. The fuel load may then be safely moved from a supply area to the fireplace or furnace or moved within the fireplace or furnace. Once this is accomplished, the fuel load is released by releasing lever 32 to allow spring 36 to pivot clinch lock 30 into the unlocked position and then manually separating gripper elements 18, 22 using carrying member 20.

In this disclosure, there is shown and essentially described only the preferred embodiment of the invention, but as mentioned above, it is to be understood that the invention is capable of changes or modifications within the scope of the inventive concept expressed herein. Several of these obvious changes or modifications have been briefly mentioned for purposes of illustration.

I claim:

1. A locking tong apparatus for securely grasping variable size fireplace or furnace fuel, comprising:

an elongate arm having a handle end and a remote end, a first, fixed gripper element being provided at said remote end;

a second, movable gripper element;

a carrying member for said second gripper element, said carrying member being slideably mounted on said arm and adapted to be manually moved along substantially the entire length thereof between said handle end and said remote end;

said first and second gripper elements defining a jaw for gripping the fuel;

locking means on said carrying member for selectively locking said carrying member into a position on said arm to securely grasp and retain the fuel in said jaw;

said locking means comprising a lever having an elongate arm-surrounding portion formed on one end thereof; said arm-surrounding portion being pivotable between a first, unlocked position and a second, locked position, and said arm-surrounding portion being coaxial with said arm in the first position and being non-coaxial with said arm in the second position, said arm-surrounding portion includng means for biting into opposite outer surface portions of said arm in said locked position.

2. The apparatus of claim 1 wherein said biting means is formed by opposite edges of the inner surface of said arm-surrounding portion.

3. The apparatus of claim 1 including spring biasing means for resiliently biasing said arm-surrounding portion into the first position.

4. The apparatus of claim 3 wherein said carrying member comprises a hollow member and a bushing maintained rigidly spaced apart from one another; the arm-surrounding portion of said lever and said spring biasing means being located between said hollow member and said bushing; said arm passing through the hollow member, bushing, and the arm-surrounding portion of said lever.

5. The apparatus of claim 4 wherein said arm also passes through said spring biasing means.

6. The apparatus of claim 4 wherein said bushing is rigidly spaced apart from said hollow member by a plurality of bridging elements.

7. The apparatus of claim 1 wherein said first and second gripper elements comprise respectively first and second mutually opposed gripper teeth.

8. The apparatus of claim 1 wherein said elongate arm is a rod.

9. The apparatus of claim 4 wherein said hollow member is a conduit.

* * * * *